US005758387A

United States Patent [19]

McNamara

[11] Patent Number: 5,758,387

[45] Date of Patent: Jun. 2, 1998

[54] VACUUM ASHTRAY SYSTEM

[76] Inventor: Wayne R. McNamara, R.R. 3 Box 51, Spring Valley, Minn. 55975

[21] Appl. No.: 707,388

[22] Filed: Sep. 4, 1996

[51] Int. Cl.[6] ..... A47L 5/38

[52] U.S. Cl. ..... 15/301; 15/314; 55/385.8

[58] Field of Search ..... 15/301, 313, 314; 55/385.8

[56] References Cited

U.S. PATENT DOCUMENTS

| | | | |
|---|---|---|---|
| 3,663,432 | 5/1972 | Ellison | 15/313 X |
| 4,061,149 | 12/1977 | Raczkowski | 15/313 X |
| 5,276,938 | 1/1994 | Cadwell et al. | 15/301 X |
| 5,542,438 | 8/1996 | Adams et al. | 55/385.8 X |
| 5,562,286 | 10/1996 | Brinket | 55/385.8 X |
| 5,649,997 | 7/1997 | Cavallero et al. | 55/385.8 X |

*Primary Examiner*—Chris K. Moore

[57] ABSTRACT

A vacuum and piping system can be installed on tables, bars, and the like, quickly and effectively for the purpose of removing cigarette smoke. The multi-component system includes vacuum nozzles, ashtrays which are threadably attachable to the nozzles, a system of smoke removing piping, and a large filtering tank and vacuum cleaning unit located at a remote location. The vacuum cleaning unit employs a wet and dry vacuum cleaner to pull cigarette smoke from ashtrays and overhead smoke capturing nozzles and direct it to a water filter for cleansing. The ashtrays are fixedly secured to tables and bars, and they include threadably openable and closeable nozzles. When open, the nozzles may be used to withdraw cigarette smoke to the cleaning filter, and when closed, water may be piped through the system for purposes of removing captured ashes and other debris. The nozzles may also be partially opened to allow a fine spray of water to be directed into ashtrays so that they can easily cleaned with a hand cloth.

10 Claims, 3 Drawing Sheets

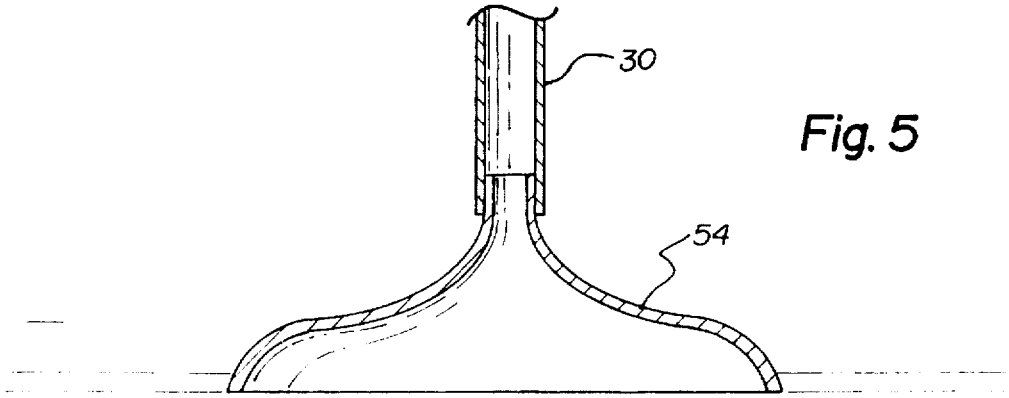
Fig. 5
Fig. 6
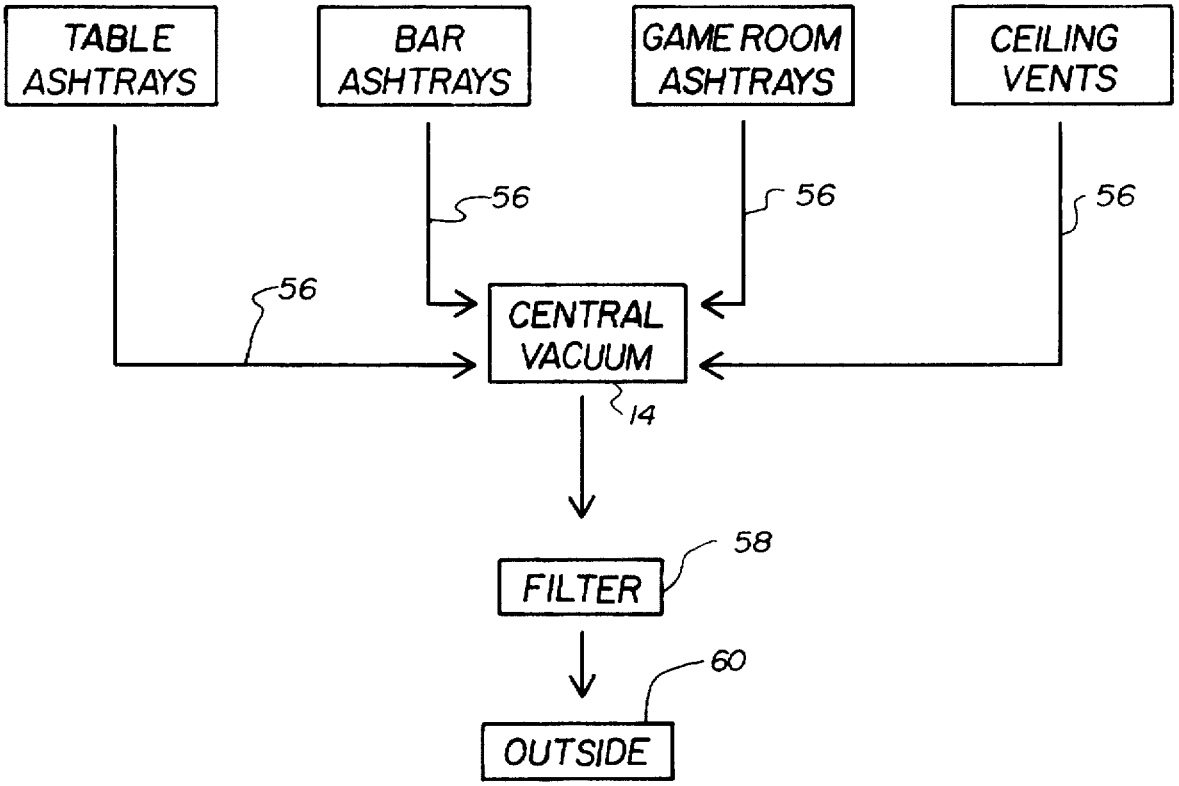

VACUUM ASHTRAY SYSTEM

BACKGROUND OF THE INVENTION

1. Field of the Invention

The present invention pertains to smoke removing devices, and more particularly pertains to a vacuum operated smoke removal system for use in entertainment establishments.

2. Description of the Prior Art

The use of smoke removing and cleaning systems is well known in the prior art, and this is evidenced by the granting of a number of patents relating to various functional and structural aspects of such devices.

A typical example of an ashtray smoke remover is to be found in U.S. Pat. No. 3,797,205 which issued Weisskopf on Mar. 19, 1974. In this patent, there is disclosed an ashtray which is combined with an optionally actuatable smoke filter system and ducts which may be adjustably moved to the smoke source for sucking in smoke filled air, whereby it can then be directed through the ducts to a remote location for disposal.

Another patent of interest is U.S. Pat. No. 5,181,883 which issued to Hofstra et al. on Jan. 26, 1993. This patent discloses a smoker's booth for isolating, containing, venting and filtering tobacco smoke. The booth consists of a walled enclosure having a smoker's access aperture, and when the presence of a smoker is detected, the activation of venting, filtering, and lighting mechanisms is accomplished.

A patent of more pertinence to the present invention is U.S. Pat. No. 5,306,207 which issued to Corts on Apr. 26, 1994. This patent discloses an air removal apparatus which may be used in an entertainment establishment and which includes an air duct having a plurality of apertures arrayed along its length, and an electrical fan assembly is connected to the duct for creating a vacuum therein. A plurality of smaller conduits extend from the apertures down to collars which may be positioned on tables and in which conventional ashtrays may be placed. The collars are provided with apertures in fluid communication with the main air duct so that smoke from the ashtrays is drawn into the system for delivery to a remote location. No provision is made however to ensure that a smoker will maintain an ashtray within the collar, i.e., the ashtray can be removed at the discretion of the smoker which would thereby negate the usefulness of this invention.

As such, there apparently still exists the need for a new and improved cigarette smoke removing system wherein there would be no feasible way for a smoker to circumvent the effectiveness thereof, and in this respect, the present invention substantially fulfills this need.

SUMMARY OF THE INVENTION

In view of the foregoing disadvantages inherent in the known types of cigarette smoke removing systems now present in the prior art, the present invention provides a new cigarette smoke removing system having advantages and improvements which are patentably distinct over similar devices and methods which may already be patented or commercially available. As such, the general purpose of the present invention, which will be described subsequently in greater detail, is to provide a cigarette smoke removing system and method which has many of the advantages of the cigarette smoke removing systems mentioned heretofore while being operable to overcome problems not presently addressed by the prior art.

To attain this, the present invention generally comprises a vacuum and piping system which can be installed on tables, bars, and the like, quickly and effectively for the purpose of removing cigarette smoke. The multi-component system includes vacuum nozzles, ashtrays which are threadably attachable to the nozzles, a system of smoke removing piping, and a large filtering tank and vacuum cleaning unit located at a remote location. The vacuum cleaning unit employs a wet and dry vacuum cleaner to pull cigarette smoke from ashtrays and overhead smoke capturing nozzles and direct it to a water filter for cleansing. The ashtrays are fixedly secured to tables and bars, and they include threadably openable and closeable nozzles. When open, the nozzles may be used to withdraw cigarette smoke to the cleaning filter, and when closed, water may be piped through the system for purposes of removing captured ashes and other debris. The nozzles may also be partially opened to allow a fine spray of water to be directed into ashtrays so that they can easily cleaned with a hand cloth.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new cigarette smoke removing system and method which has many of the advantages of the cigarette smoke removing systems mentioned heretofore and many novel features that result in a cigarette smoke removing system which solves problems not presently addressed in the prior art.

It is another object of the present invention to provide a new cigarette smoke removing system which may be easily and efficiently manufactured and marketed.

It is a further object of the present invention to provide a new cigarette smoke removing system which is of a durable and reliable construction.

An even further object of the present invention is to provide a new cigarette smoke removing system which is susceptible of a low cost of manufacture with regard to both materials and labor, and which accordingly is then susceptible of low prices of sale to the consuming public, thereby making such cigarette smoke removing system economically available to the buying public.

Still yet another object of the present invention is to provide a new cigarette smoke removing system which provides in the apparatuses and methods of the prior art some of the advantages thereof, while simultaneously overcoming some of the disadvantages normally associated therewith. ___

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is cross-sectional view of a further component comprising a part of the present invention.

FIG. 6 is a flow chart illustrating the manner of operation of the present invention.

DESCRIPTION OF PREFERRED EMBODIMENTS

Figure 1:
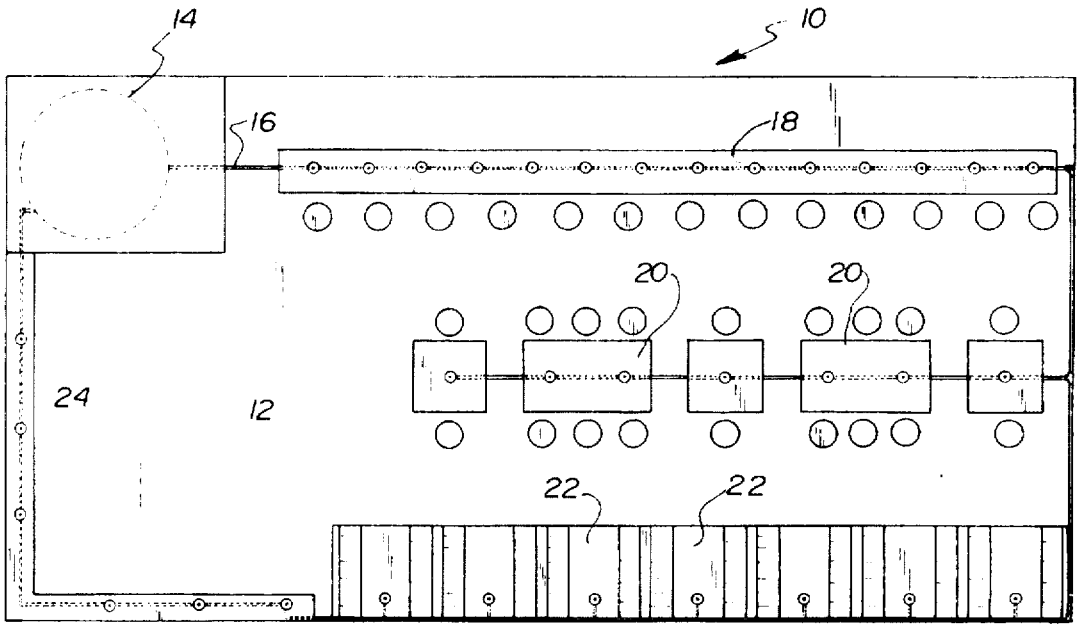
FIG. 1 is top plan view of the smoke removing system comprising the present invention.

With reference now to the drawings, and in particular to FIGS. 1–4 thereof, a new cigarette smoke removing system embodying the principles and concepts of the present invention and generally designated by the reference numeral 10 will be described.

More specifically, it will be noted that the cigarette removing system 10 is designed to be typically used in a conventional entertainment establishment 12 and includes a remotely positioned wet and dry vacuum cleaner 14 having a circuitous conduit system 16 operably attached thereto. As shown in FIG. 1, the conduit system 16 may extend across a bar 18 in the establishment and also be aligned with a plurality of tables, each of which is generally designated by the reference numeral 20, and a plurality of booths, each of which is generally designated by the reference numeral 22. A wall mounted table or bar 24 may also be provided in the loop and as can be appreciated, the vacuum cleaner 14 effectively draws a continuous supply of air through the conduit system 16 to an unillustrated air filtration system.

Figure 2:
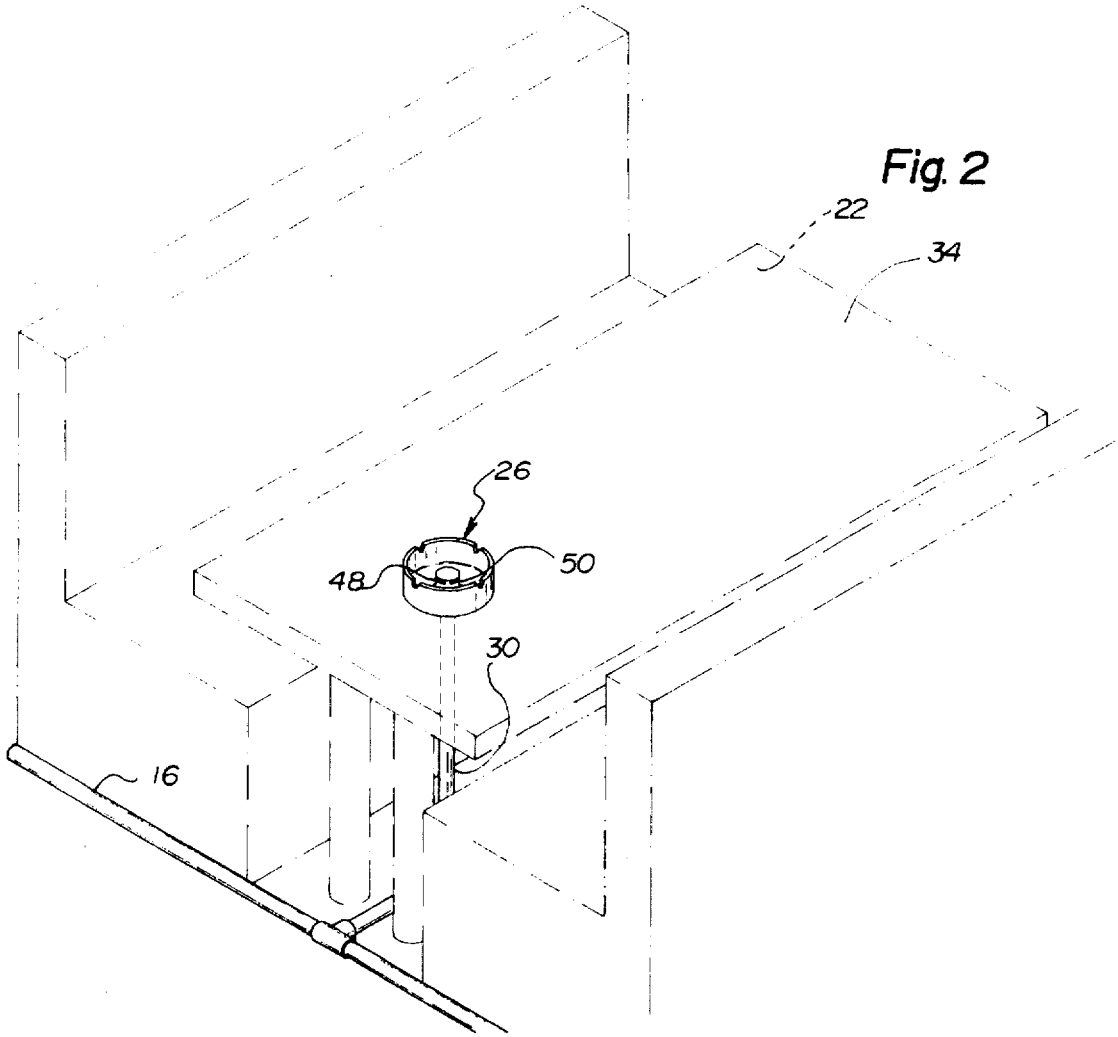
FIG. 2 is a perspective view showing a component of the system.
Figure 3:
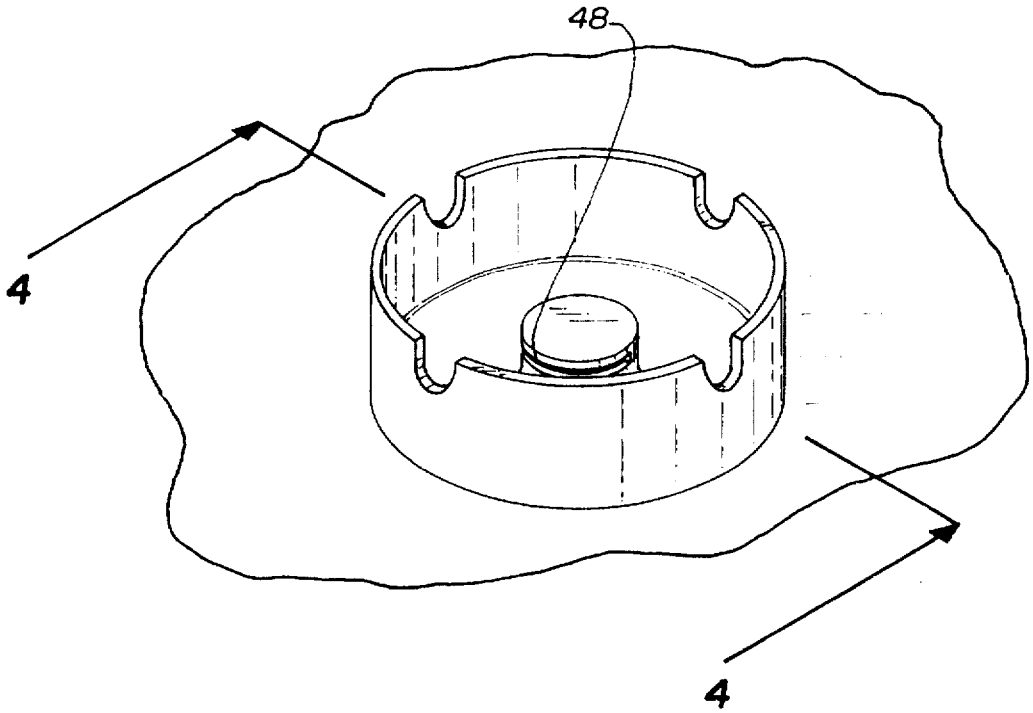
FIG. 3 is an enlarged perspective view of an ashtray comprising a part of the present invention.

FIG. 2 of the drawing illustrates how an ashtray 26 may be fixedly secured to the central conduit 16 so as to remove cigarette smoke from a booth 22, a table 20, a bar 18, or the like, without any concern that the effectiveness of the ashtray can be neutralized by a smoker. More particularly and with reference to FIG. 4 in conjunction with FIG. 2, it can be seen that a T-connector 28 may be provided in the main vacuum line 16 from which a feeder conduit 30 of any length and direction can be provided. The feeder 30 will be directed up through an aperture 32 formed in a table surface 34 and the free end of the feeder will be provided with external threads 36 on a portion of the feeder which extends through the aperture 32.

Figure 4:
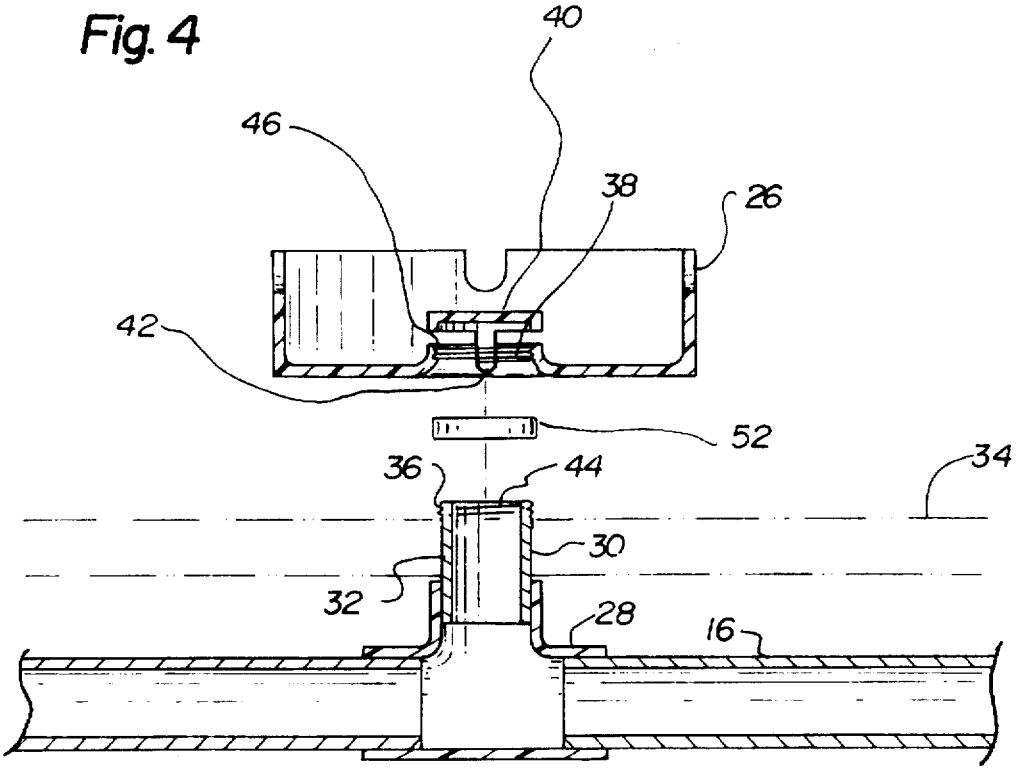
FIG. 4 is a cross-sectional view of the invention as viewed along the line 4—4 in FIG. 3.

The ashtray 26 will be specially constructed to include a bottom through-extending, internally threaded aperture 38, and this threaded aperture 38 is threadably engageable with the external threads 36 on the feeder pipe 30. As such, when the ashtray 26 is threadably attached to the feeder 30, it is permanently secured to the table surface 34 so that it can not be easily displaced or removed by a smoker. A cap member 40 includes a pair of downwardly extending arms 42 which are oppositely disposed from each other and only one of which is shown in FIG. 4.

The arms 42 are externally threaded whereby the cap member is engageable with internal threads 44 formed in the free end of the feeder conduit 30 and laying proximate to the external threads 36, whereby the cap 40 may be threadably moved downwardly into the feeder pipe 30 until it comes into abutment with a top extending lip 46 forming a part of the aperture 38. By the same token, when the closure 40 is threadably moved outwardly from the feeder conduit 30, a pair of air receiving gaps 48, 50, as shown in FIG. 2, are opened so as to allow the intake of air into the vacuum line 16 in a now understood manner.

As such, the threadably removable closure 40 allows ashtrays 26 to be shut off from the vacuum line 16 in those instances where the ashtrays are attached to tables which might for an evening be designated as a non-smoking area. In the alternative, an ashtray 26 can be removed from a feeder conduit 30 and a threadably attachable cap 52 can be secured over the conduit where a table 18, 20, 22, 24 might be permanently designated as a non-smoking area.

Additionally, through the use of the closures 40, all of the ashtrays 26 can be closed off periodically to allow water to be flushed through the main vacuum line 16 and the feeder conduits 30, thereby to clean ashes and other debris therefrom. Further, at each table, an operator can momentarily unscrew a closure 40 to allow a fine high pressure spray of water to be emitted out of the openings 48, 50 into the ashtray 26 during that period of time that water is being directed through the entire system 10. The operator can then threadably close the closure 40 and use a rag to clean the inside of a particular ashtray, whereby the vacuum system also operates as a water cleaning system for all of the ashtrays in the entertainment establishment 12.

FIG. 5 of the drawings illustrates the use of an overhead nozzle 54 which can be attached to a feeder pipe 30 extending downwardly from a ceiling in the entertainment establishment 12. The nozzle 54 would capture smoke which might rise towards the ceiling of the establishment 12, and it would most likely be provided with a lower position valve structure to shut off air flow therethrough during those periods of time that water is directed through the lowermost vacuum line 16. In this connection, if a floor level valve system was not used to prevent water flow into the nozzle 54, water flowing into the ceiling system would have to be ejected through the nozzles 54 which would effectively and undesirably cause water damage to the furniture below.

FIG. 6 of the drawings is provided as a schematic to illustrate the manner of usage of the present invention. In this respect, ashtrays located at a plurality of locations are all attached by conduits 56 to the wet and dry vacuum cleaner 14, and the smoke filled air is then directed through a filter 58 and subsequently to an outside location 60.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved smoke removal system for use in a building structure comprising:

a vacuum cleaner;

at least one conduit attached to said vacuum cleaner, said at least one conduit being operable to draw a supply of air from a remote location to said vacuum cleaner;

at least one ashtray operably attached to said at least one conduit; and nozzle means attached to said ashtray for operably controlling a supplying of said air to said at least one conduit when said vacuum cleaner is operational, said at least one conduit having an open end communicating with the interior of said ashtray, and said nozzle means including a removable cap positioned on said open end of said at least one conduit, thereby to allow smoke-filled air to be selectively sucked past said ashtray into said at least one conduit for delivery to said vacuum cleaner.

2. The new and improved smoke removal system for use in a building structure as described in claim 1 wherein said cap is threadably attached to said open end of said at least one conduit.

3. The new and improved smoke removal system for use in a building structure as described in claim 2 wherein said open end of said at least one conduit is threadably attached to said ashtray, thereby to prevent a removal of said ashtray from said at least one conduit.

4. The new and improved smoke removal system for use in a building structure as described in claim 3 wherein said at least one conduit is selectively sealable to permit a supply of cleansing fluid to be directed therethrough.

5. The new and improved smoke removal system for use in a building structure as described in claim 4 wherein said vacuum cleaner is a wet and dry vacuum cleaner, whereby said cleansing fluid can be removed from said at least one conduit by said vacuum cleaner.

6. The new and improved smoke removal system for use in a building structure as described in claim 5 wherein said cap can be threadably adjusted to allow a fine spray of said cleansing fluid to be directed into said ashtray, thereby to facilitate a cleaning of said ashtray with a hand cloth.

7. The new and improved smoke removal system for use in a building structure as described in claim 6, and further including a water filter for cleaning said air after it passes through said vacuum cleaner.

8. The new and improved smoke removal system for use in a building structure as described in claim 1, and further including a water filter for cleaning said air after it passes through said vacuum cleaner.

9. A new and improved smoke removal system for use in a building structure comprising:

a vacuum cleaner;

at least one conduit attached to said vacuum cleaner, said at least one conduit being operable to draw a supply of air from a desired location to said vacuum cleaner;

at least one ashtray operably attached to said at least one conduit;

and at least one overhead air collection nozzle being operably attached to said at least one conduit.

10. The new and improved smoke removal system for use in a building structure as described in claim 9, and further including a water filter for cleaning said air after it passes through said vacuum cleaner.

* * * * *